US008013695B2

(12) United States Patent
Suzuki et al.

(10) Patent No.: US 8,013,695 B2
(45) Date of Patent: Sep. 6, 2011

(54) ELECTRONIC OVERLOAD RELAY

(75) Inventors: Kenichirou Suzuki, Chiyoda-ku (JP); Sadaaki Baba, Chiyoda-ku (JP); Tomoyuki Kamiyama, Chiyoda-ku (JP); Tsuyoshi Sekiguchi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 135 days.

(21) Appl. No.: 12/596,907

(22) PCT Filed: Apr. 27, 2007

(86) PCT No.: PCT/JP2007/059249

§ 371 (c)(1),
(2), (4) Date: Oct. 21, 2009

(87) PCT Pub. No.: WO2008/139533

PCT Pub. Date: Nov. 20, 2008

(65) Prior Publication Data

US 2011/0057750 A1 Mar. 10, 2011

(51) Int. Cl.
*H01H 75/00* (2006.01)

(52) U.S. Cl. ..... 335/6; 335/26; 335/27; 335/28; 335/78; 335/86; 335/176; 335/179

(58) Field of Classification Search ..... 335/6, 17, 335/21, 26–28, 78–86, 172, 176, 179
See application file for complete search history.

(56) References Cited

U.S. PATENT DOCUMENTS

| | | | | |
|---|---|---|---|---|
| 5,959,518 | A | 9/1999 | Passow | |
| 5,994,987 | A | 11/1999 | Passow | |
| 6,020,801 | A | 2/2000 | Passow | |
| 7,639,107 | B2 * | 12/2009 | Ohkubo et al. | 335/78 |
| 2004/0085702 | A1 | 5/2004 | Ohkubo | |
| 2008/0272866 | A1 | 11/2008 | Ohkubo et al. | |

FOREIGN PATENT DOCUMENTS

| | | | |
|---|---|---|---|
| JP | 2001-520795 | A | 10/2001 |
| JP | 2002-516457 | A | 6/2002 |
| JP | 2002-543552 | A | 12/2002 |
| JP | 2004-022203 | A | 1/2004 |
| TW | 175213 | | 12/1991 |
| TW | 540077 | B | 7/2003 |
| WO | 2006/114870 | A1 | 11/2006 |

* cited by examiner

*Primary Examiner* — Ramon M Barrera
(74) *Attorney, Agent, or Firm* — Sughrue Mion, PLLC

(57) ABSTRACT

A magnetic circuit includes a stationary iron core, a permanent magnet, and an armature, in a circular pattern. A contact mechanism spring separates the armature from the stationary iron core to open the magnetic circuit to switch a contact mechanism to a reset position. A coil on the magnetic circuit generates a magnetic flux in a direction same as that of the permanent magnet when an overload is detected and in an opposite direction when a predetermined time is elapsed after detecting the overload. A reset bar switches a movable stopper between an engaging position and a non-engaging position with the contact mechanism against a biasing force of the contact mechanism spring.

7 Claims, 17 Drawing Sheets

ELECTRONIC OVERLOAD RELAY

TECHNICAL FIELD

The present invention relates to an electronic overload relay (hereinafter, also referred to as simply "overload relay") that protects a motor or the like from an overload.

BACKGROUND ART

An electronic overload relay detects a load current of a motor by a current detecting device (such as a CT), and if a detected load current exceeds a set value, the electronic overload relay flows operating current to a polarized electromagnet from a current detection circuit, and performs a trip operation for opening and closing a control circuit contact.

By the trip operation, a normally-open contact (contact a) is closed to turn on an indicator lamp, and a normally-closed contact (contact b) is opened to release excitation of an electromagnet of an electromagnetic contactor of a load circuit of a motor, thereby blocking the load circuit to prevent an accident such as burnout of the motor. After the trip operation, to restart the motor, it is necessary to perform a reset operation for returning the overload relay to a state before the trip operation (a state where the normally-open contact is opened and the normally-closed contact is closed).

The reset operation includes a manual reset operation that is performed by operating a reset bar, and an automatic reset operation that is performed by operating a polarized electromagnet using operating current output from a current detection circuit after a predetermined time is elapsed after the trip operation. This reset operation has to be performed after the cause of the overload of the load circuit of the motor is eliminated.

The overload relay needs a trip free function capable of performing a trip operation without any problem when an overload of the motor (load) is detected by a current detecting device even when an electric wire hits the reset bar for some sort of reason and the reset operation is performed, a manual/automatic switching function of the reset operation, and a function for prohibiting the reset operation for a predetermined time after the trip to prohibit the motor from restarting before the motor is cooled or the motor is recovered from its abnormal condition.

As a conventional overload relay having these three functions, there is an overload relay including a polarized electromagnet having a permanent magnet and a coil in a magnetic circuit, in which an armature is attracted and held in a reset position against a spring force by a magnetic field of the permanent magnet, and a magnetic field in a direction opposite to the permanent magnet is generated when an overload is detected, a contact mechanism that is operated in association with an armature, and a reset bar that returns the released armature to the reset position. This overload relay includes an inversion mechanism that is alternately inverted to a reset side and a trip side when crossing a dead center of a spring function, thereby switching the contact mechanism, the inversion mechanism is pushed by the released armature to invert the inversion mechanism to the trip side from the reset side, the inversion mechanism that is inverted to the trip side is pushed by the reset bar toward the reset side, and when the armature is released when an overload is detected, the coil is energized such that a magnetic field is generated in the same direction as the permanent magnet after a predetermined time is elapsed, the released armature is returned to the reset position and then, the reset bar is pushed, thereby inverting the inversion mechanism to the reset side (for example, see Patent Document 1).

According to this overload relay, the reset bar can be locked in its pushed-in state, and when the inversion mechanism is pushed toward the trip side by the armature in the pushed-in state, the inversion mechanism is prevented from inverting by the reset bar before crossing the dead center so that the automatic resetting can be performed.

Patent Document 1: Japanese Patent Application Laid-open No. 2004-022203

DISCLOSURE OF INVENTION

Problem to be Solved by the Invention

However, according to the conventional overload relay described above, when the reset bar is locked in a pushed-in state in an automatic reset mode, a contact gap of the normally-open contact of the contact mechanism that is operated in association with the armature and an over-travel amount are smaller than a contact gap of the normally-open contact in a manual reset mode and an over-travel amount of the contact. Therefore, there is a problem that, in the automatic reset mode, a resistance to pressure and contact capacity of the normally-open contact become small.

Further, when resetting in the manual reset mode, similarly to the automatic reset mode, there is a problem that it is necessary to supply reset current to the polarized electromagnet from the current detection circuit to operate the polarized electromagnet, test trip/reset operation cannot be performed in a non-energization state, and operations of the contact mechanism cannot be checked in a non-energization state.

The present invention has been achieved in view of the above problems, and an object of the present invention is to obtain an overload relay in which a contact gap and an over-travel amount of a normally-open contact in an automatic reset mode do not become smaller than a contact gap and an over-travel amount in a manual reset mode, and its resistance to pressure and contact capacity are not reduced.

Means for Solving Problem

To solve the above problems and to achieve the object, an electronic overload relay according to the present invention is packaged in a case, including a contact mechanism that is switched between a trip position at which an overload signal is transmitted and a reset position at which a standby signal is transmitted; a magnetic circuit that includes a stationary iron core, a permanent magnet, and an armature that is fixed to the contact mechanism and that is switched between a trip position at which the armature is attracted by the stationary iron core and a reset position at which the armature is separated from the stationary iron core, arranged in a circular pattern; a contact mechanism spring that separates the armature from the stationary iron core and opens the magnetic circuit to bias such that the contact mechanism is switched to the reset position; a coil that is arranged on the magnetic circuit, generates a magnetic flux in a same direction as a magnetic flux of the permanent magnet by energization when an overload is detected, thereby switching the armature from the reset position to the trip position against the contact mechanism spring, and generates a magnetic flux in a direction opposite to the magnetic flux of the permanent magnet by energization in the opposite direction when a predetermined time is elapsed after detecting an overload, thereby opening and separating the armature held at the trip position from the stationary iron core by an attracting force of the permanent magnet; a movable stopper that engages with the contact mechanism against a biasing force of the contact mechanism spring at a position where the armature is slightly separated from the stationary iron core; and a reset bar that switches the movable stopper between an engaging position where the contact mechanism is engaged and a non-engaging position.

Effect of the Invention

In the overload relay according to the present invention, the reset position of the contact mechanism is always the same, the contact gap and the over-travel amount of the normally-open contact of the contact mechanism are always the same, the resistance to pressure and contact capacity of the normally-open contact in the automatic rest mode do not become smaller than the resistance to pressure and contact capacity of the normally-open contact in the manual reset mode.

BRIEF DESCRIPTION OF DRAWINGS

FIG. 19 is a front view of a state where, in the reset state of the manual reset mode, the reset bar is pushed in.

EXPLANATIONS OF LETTERS OR NUMERALS

Figure 1:
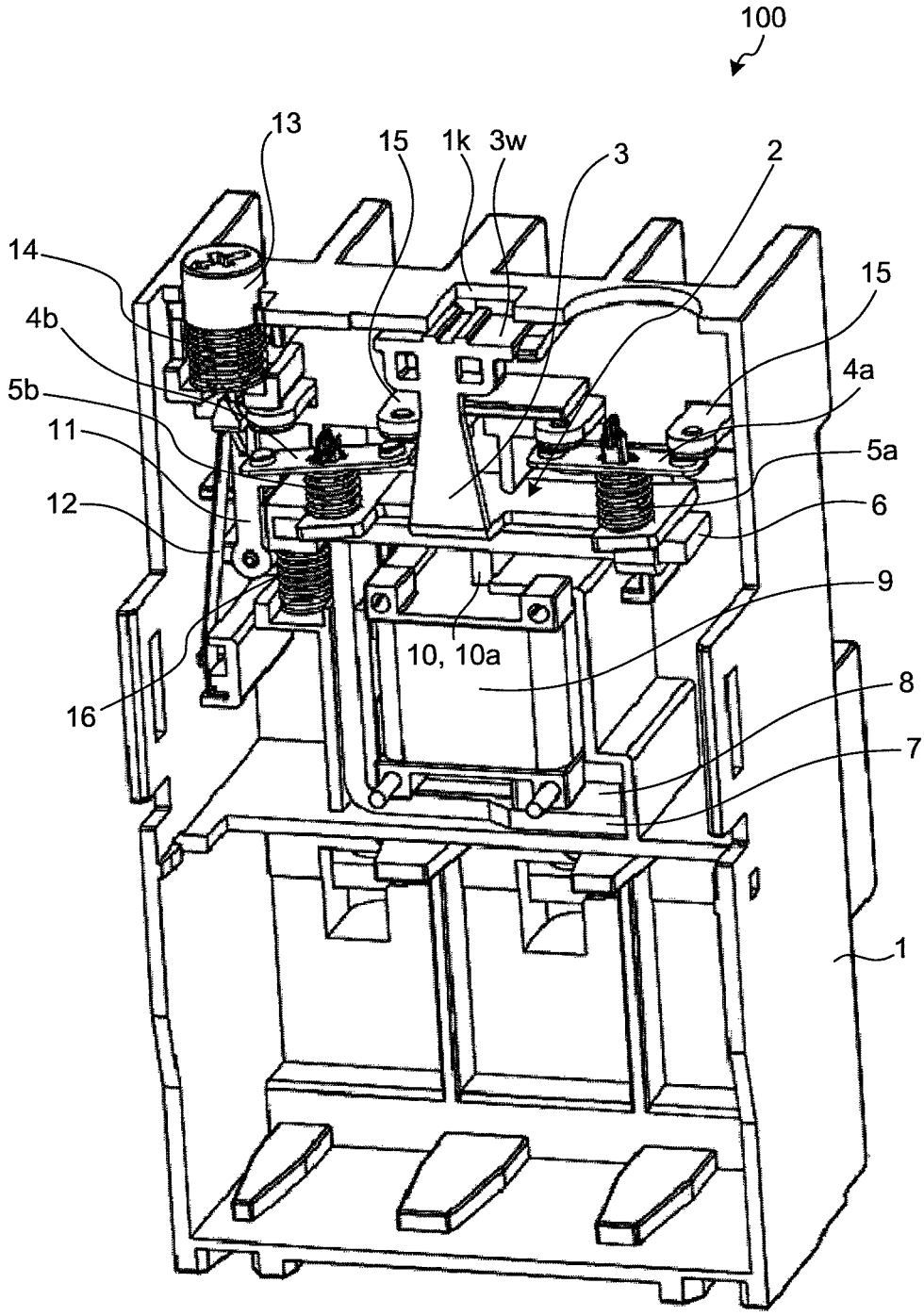
FIG. 1 is a perspective view of an embodiment of an overload relay according to the present invention.

1 case
1*a* spindle
1*b* leaf spring holder
1*c* rectangular hole
1*d* spring holder
1*e* CT accommodating unit
1*f* reset position stopper
1*g* stopper projection
1*h* bar stopper
1*i* rib
1*j* projection
1*k* window
1*m* L-shaped groove
1*n* rectangular frame
2 contact mechanism
3 cross bar
3*a*, 3*b* spring column
3*c*, 3*d*, 3*e* armature holder
f spring fitting unit
3*w* display unit
3*x* left projection stripe
3*y* right projection stripe
4*a* normally-open movable contact element
4*b* normally-closed movable contact element
5*a* normally-open contact spring
5*b* normally-closed contact spring
6 armature
7 first stationary iron core
8 permanent magnet
9 coil
9*a* hole
9*b* trip coil
9*c* reset coil
10 second stationary iron core
10*a* armature shaft
1 movable stopper
11*a* shaft hole
11*b* inclined end surface
11*c* intermediate engaging unit
12 stopper leaf spring
13 reset bar
13*a* shaft
13*b* inclined surface
13*c* lower projection
13*d* outer peripheral projection
13*e* arrow groove
14 reset bar spring
15 stationary contact element
16 contact mechanism spring
20 front cover
100 electronic overload relay

BEST MODE(S) FOR CARRYING OUT THE INVENTION

Exemplary embodiments of an overload relay according to the present invention will be explained below in detail with reference to the accompanying drawings. The present invention is not limited to the embodiments.

Embodiments

FIG. 1 is a perspective view of an embodiment of an electronic overload relay according to the present invention, from which a front cover is detached. As shown in FIG. 1, an electronic overload relay 100 is accommodated in a rectangular parallelepiped case 1 whose front side is opened. The opened front side of the case 1 is covered with a front cover 20 shown in FIG. 14 after parts of the overload relay 100 are assembled into the case 1.

Figure 2:
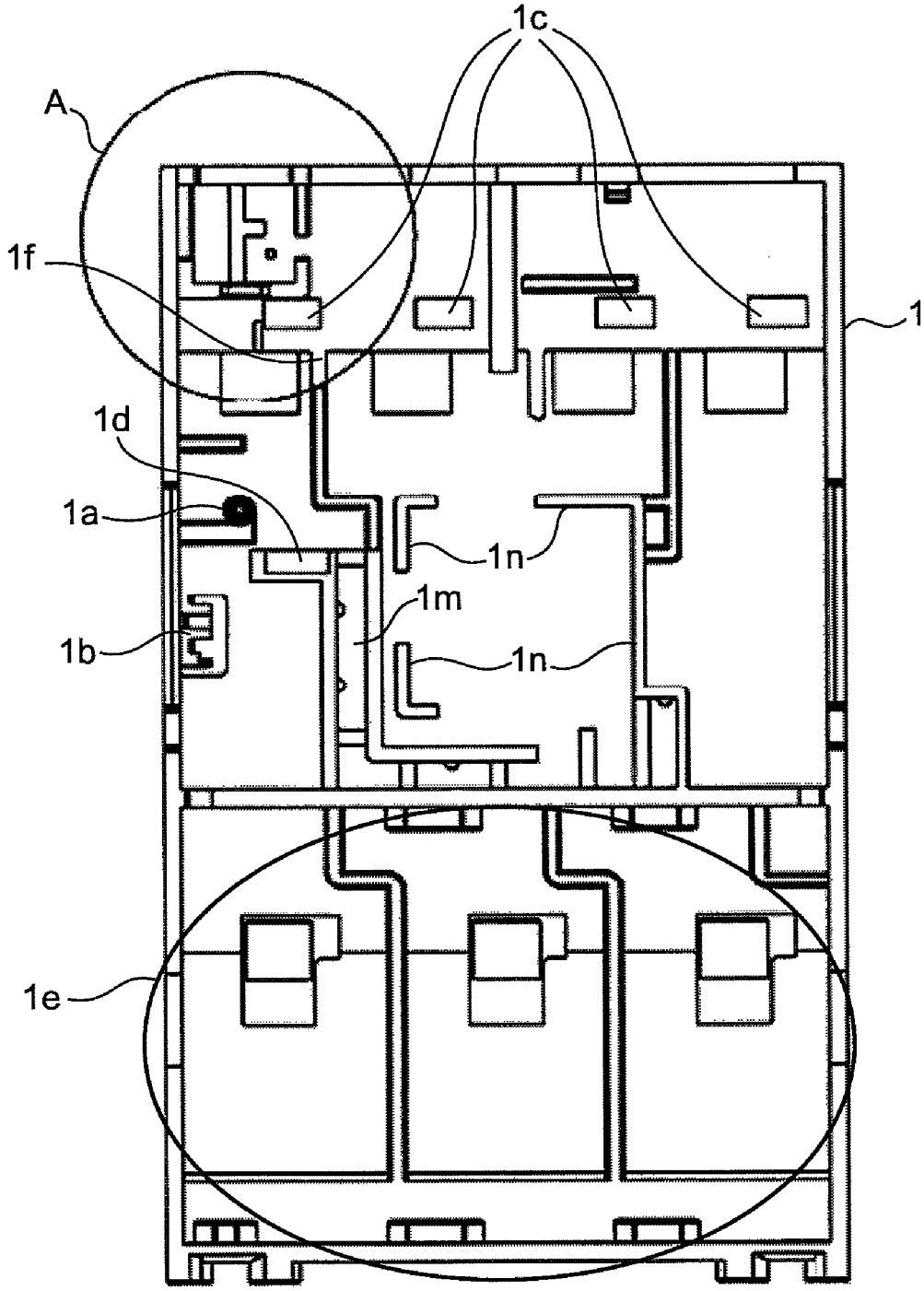
FIG. 2 is a front view of an embodiment of a case of the overload relay.
Figure 3:
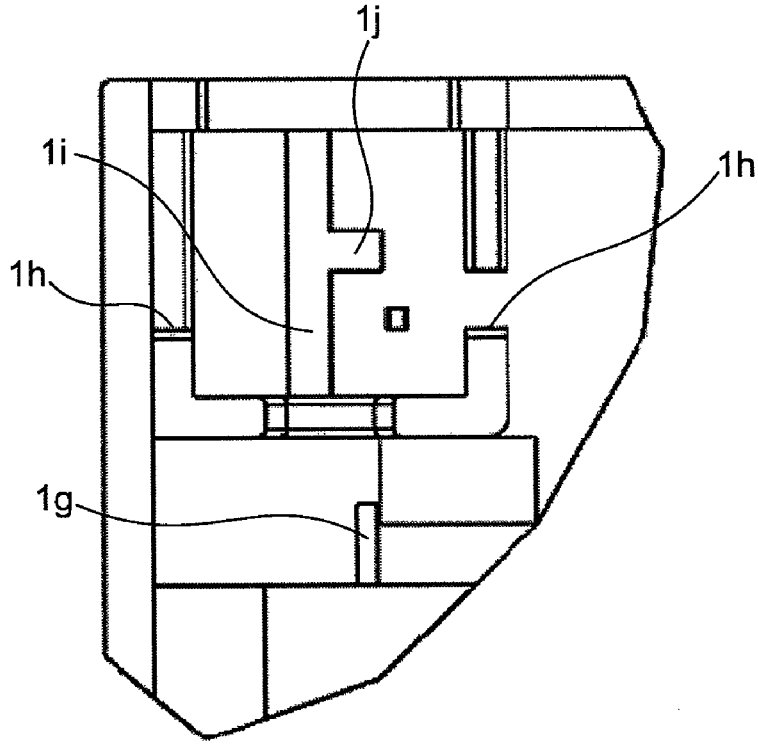
FIG. 3 is a detailed diagram of a portion A in FIG. 2.
Figure 4:
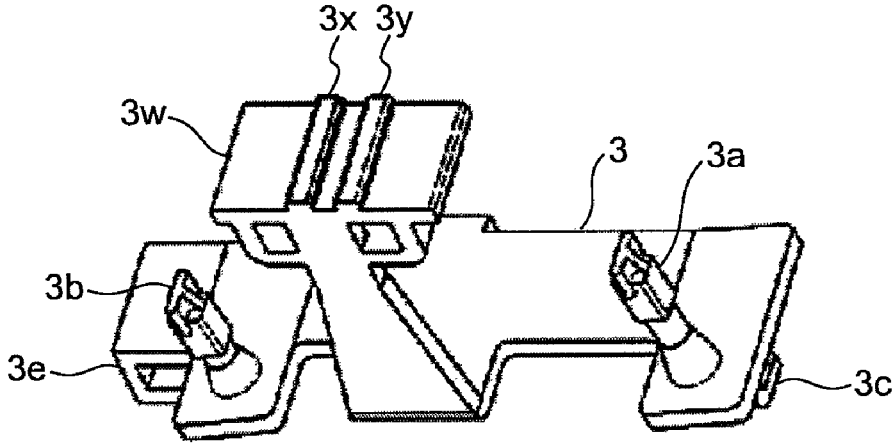
FIG. 4 is a perspective view of an embodiment of a cross bar of the overload relay.
Figure 5:
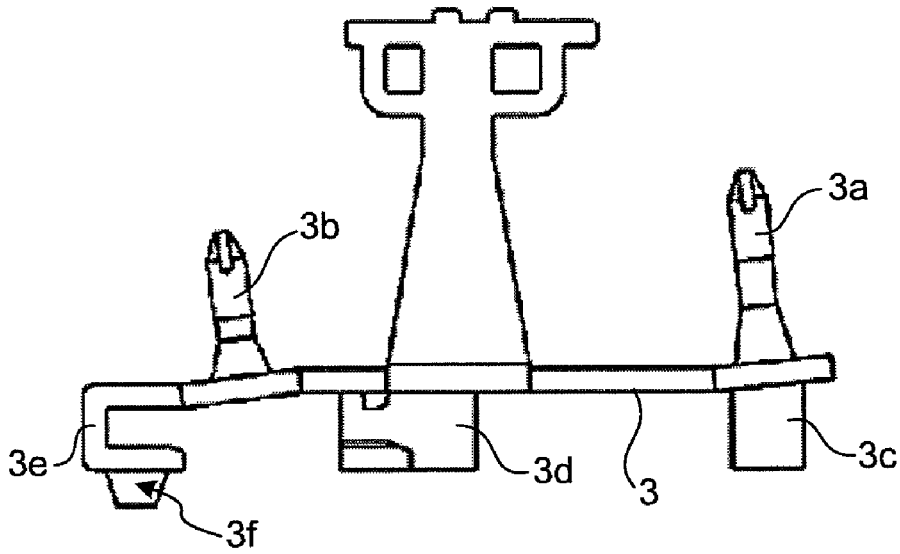
FIG. 5 is a front view of the cross bar.

FIG. 2 is a front view of an embodiment of the case of the overload relay, FIG. 3 is a detailed diagram of a portion A in FIG. 2, FIG. 4 is a perspective view of an embodiment of a cross bar of the overload relay, and FIG. 5 is a front view of the cross bar.

A contact mechanism 2 shown in FIG. 1 includes a substantially T-shaped cross bar 3 whose detailed shape is shown in FIGS. 4 and 5, a normally-open movable contact element 4*a* provided at its both ends with movable contacts, a normally-closed movable contact element 4*b* provided at its both ends with movable contacts, a normally-open contact spring 5*a*, and a normally-closed contact spring 5*b*.

Two pairs of stationary contact elements 15 come into contact and separate from the normally-open movable contact element 4*a* and the normally-closed movable contact element 4*b*, and open and close a normally-open circuit and a normally-closed circuit. The stationary contact elements 15 are inserted into and fixed to four rectangular holes 1*c* formed in an upper portion of a back wall of the case 1 shown in FIG. 2.

The normally-open contact spring 5*a* is fitted over a spring column 3*a* provided on a right end of the cross bar 3, and the normally-open movable contact element 4*a* is fitted over the normally-open contact spring 5*a*. Similarly, the normally-closed contact spring 5*b* is fitted over a spring column 3*b* provided on the left side of the cross bar 3, and the normally-closed movable contact element 4*b* is fitted over the normally-closed contact spring 5*b*.

The cross bar 3 resiliently hold the normally-open movable contact element 4*a* and the normally-closed movable contact element 4*b* by the normally-open contact spring 5*a* and the normally-closed contact spring 5*b*. An armature 6 is inserted into and fixed to three hook-like armature holders 3*c*, 3*d*, and 3*e* (see FIG. 5) provided under the cross bar 3, and the contact mechanism 2 and the armature 6 are temporarily assembled.

Figure 6:
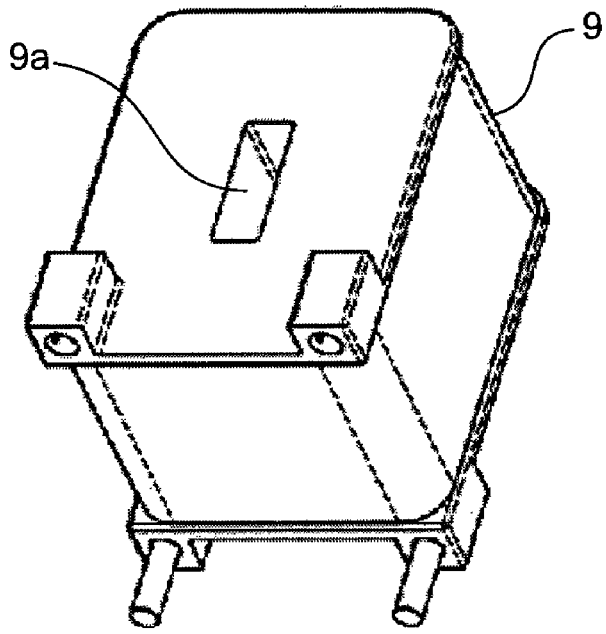
FIG. 6 is a perspective view of an embodiment of a coil of the overload relay.
Figure 7:
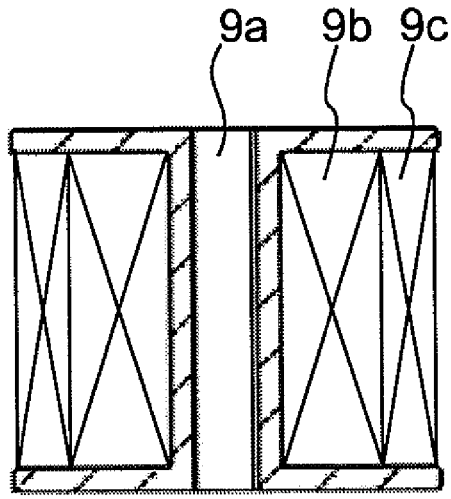
FIG. 7 is a vertical sectional view of the coil.
Figure 8:
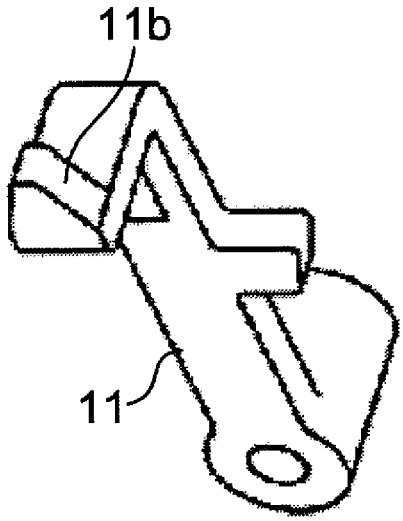
FIG. 8 is a perspective view of an embodiment of a movable stopper of the overload relay.
Figure 9:
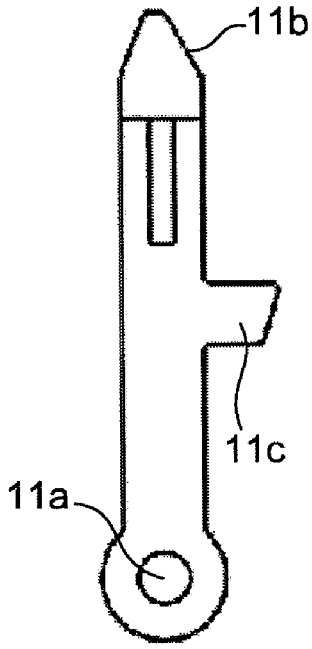
FIG. 9 is a front view of the movable stopper.
Figure 10:
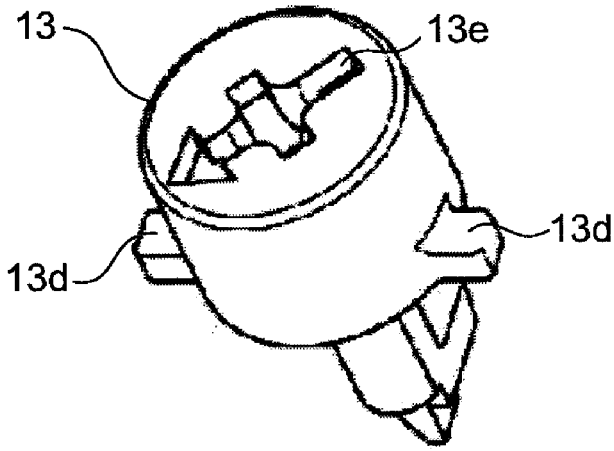
FIG. 10 is a perspective view of an embodiment of a reset bar of the overload relay.
Figure 11:
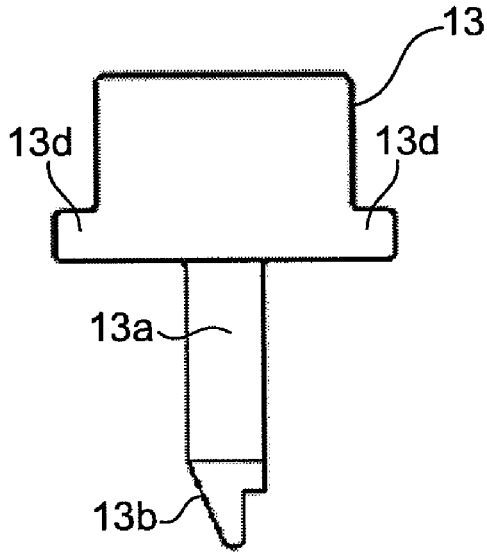
FIG. 11 is a front view of the reset bar.
Figure 12:
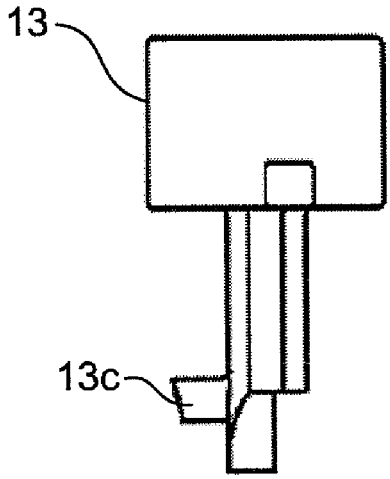
FIG. 12 is a side view of the reset bar.

FIG. 6 is a perspective view of a coil, FIG. 7 is a vertical sectional view of the coil, FIG. 8 is a perspective view of a movable stopper, FIG. 9 is a front view of the movable stopper, FIG. 10 is a perspective view of a reset bar, FIG. 11 is a front view of the reset bar, and FIG. 12 is a side view of the reset bar.

A thick plate-like permanent magnet 8 (see FIG. 13) is attached to a right end of an L-shaped plate first stationary iron core 7, and the permanent magnet 8 is fitted into an L-shaped groove 1*m* formed in a central portion of the case 1 shown in FIG. 2. An armature shaft 10*a* of an L-shaped second stationary iron core 10 (see FIG. 13) is inserted into a hole 9*a* of a rectangular parallelepiped coil 9 whose detailed shape is shown in FIGS. 6 and 7. In this state, the coil 9 is fitted into and fixed to central rectangular frames in (see FIG. 2) of the case 1, a horizontal plate (see FIG. 13) which is bent from the armature shaft 10*a* of the second stationary iron core 10 at right angles is attached to and held by the permanent magnet 8.

Next, the temporarily assembled contact mechanism 2 is supported by a pivot on an upper end of the first stationary iron core 7 and a pivot on an upper end of the armature shaft 10*a* of the second stationary iron core 10 and in this state, the contact mechanism 2 is assembled into the case 1. A hole with which the pivot of the armature shaft 10*a* is engaged is formed in a lower side of a central portion of the armature 6 of the contact mechanism 2 so that the contact mechanism 2 does not deviate from the pivot.

As is understood from the above explanations, the overload relay 100 includes the polarized electromagnet, its magnetic circuit is formed by arranging the first stationary iron core 7, the permanent magnet 8, the second stationary iron core 10, and the armature 6 supported by the pivot of the second stationary iron core 10 in a circular pattern, and the coil 9 is arranged on the magnetic circuit.

FIGS. 8 and 9 depict a detailed shape of a movable stopper 11, and a spindle 1*a* (see FIG. 2) provided on the left side of the case 1 is fitted into a shaft hole 11*a* of the movable stopper 11. A lower end of a stopper leaf spring 12 is inserted into and held in a leaf spring holder 1*b* provided on a central portion of a left side plate of the case 1, and the movable stopper 11 is pushed rightward in FIG. 1 by the stopper leaf spring 12.

FIGS. 10 to 12 depict a detailed shape of a reset bar 13. A shaft 13*a* is provided on a lower portion of the reset bar 13. A reset bar spring 14 is fitted to the shaft 13*a*. The reset bar 13 to which the reset bar spring 14 is fitted is assembled into a left upper portion of the case 1.

A contact mechanism spring 16 is provided between a spring holder 1*d* (see FIG. 2) of the case 1 and a spring fitting unit 3*f* of the cross bar 3. The contact mechanism spring 16 separates the armature 6 from the upper end of the first stationary iron core 7, opens the magnetic circuit, and biases the contact mechanism 2 so that it is switched to a reset position. The case 1 is provided at its lower portion with a CT accommodating unit 1*e* (see FIG. 2) in which three CTs (not shown), which are current detecting devices, are accommodated.

Figure 13:
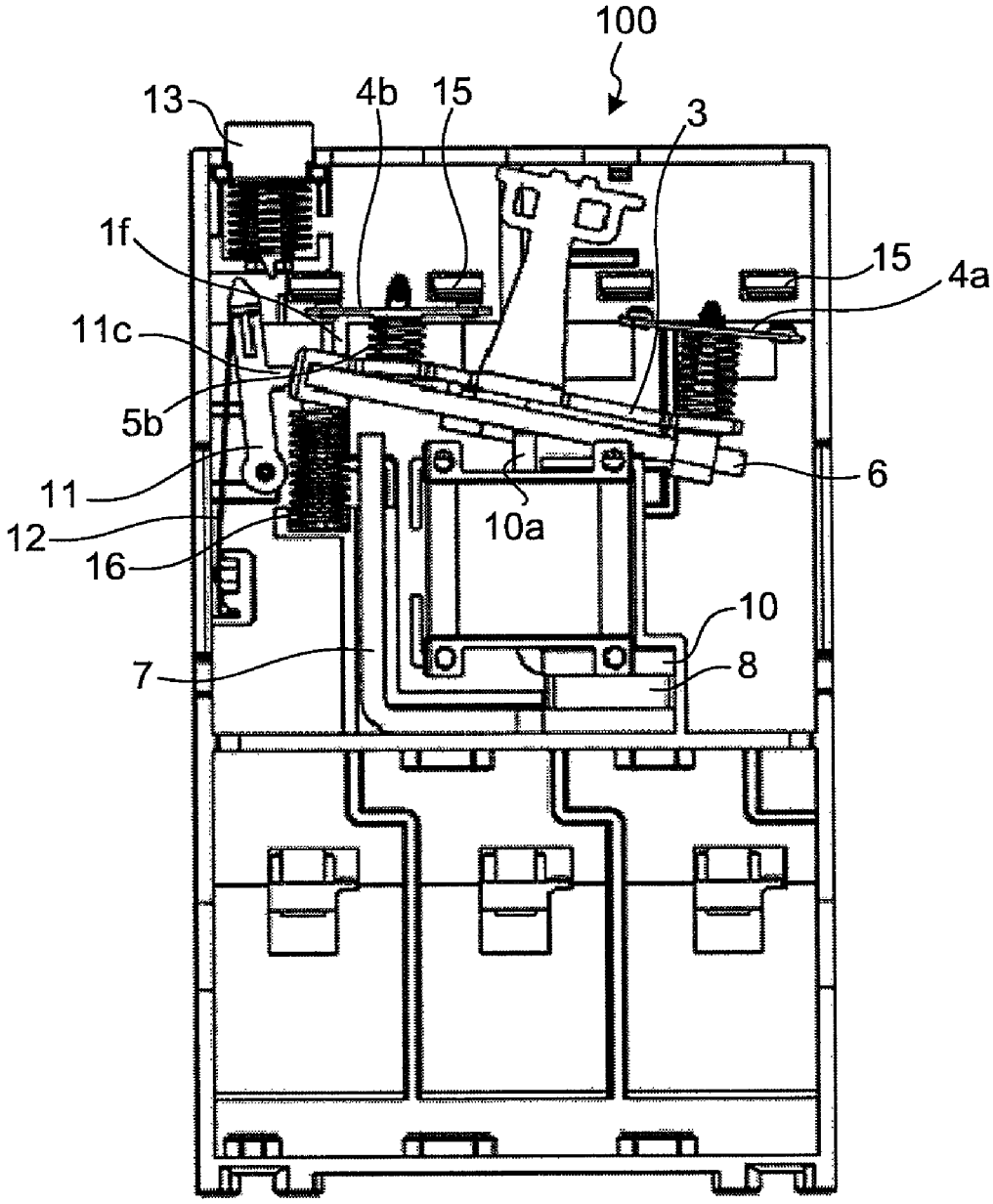
FIG. 13 is a front view of a reset state of a manual reset mode of the overload relay.

Next, an effect of the overload relay 100 according to the embodiment is explained with reference to FIGS. 13 to 22. FIG. 13 is a front view of a reset state (reset position) in the manual reset mode of the overload relay.

In the reset state of the manual reset mode, a clockwise rotation torque of the armature 6 generated by repulsion of the compressed contact mechanism spring 16 is greater than a counterclockwise rotation torque of the armature 6 generated by an attracting force of the permanent magnet 8 with respect to the armature 6 separated from the upper end of the first stationary iron core 7 and by repulsion of the compressed normally-closed contact spring 5*b*.

Therefore, the contact mechanism 2 turns clockwise around the pivot on the upper end of the armature shaft 10*a*, and the contact mechanism 2 is held at the reset position where a left end upper portion of the cross bar 3 abuts against a reset position stopper 1*f* of the case 1.

In the reset state, the movable contact of the normally-closed movable contact element 4*b* abuts against the stationary contact of the stationary contact element 15 to close the normally-closed circuit, a movable contact of the normally-open movable contact element 4*a* separates from the stationary contact of the stationary contact element 15 to open the normally-open circuit. In this reset state, the contact mechanism 2 transmits a standby signal (the normally-closed circuit is closed and the normally-open circuit is opened).

The movable stopper 11 is pressed rightward in FIG. 13 by the stopper leaf spring 12, and an intermediate engaging unit 11*c* is in abutment against the left armature holder 3*e* (see FIG. 5) of the cross bar 3.

Figure 14:
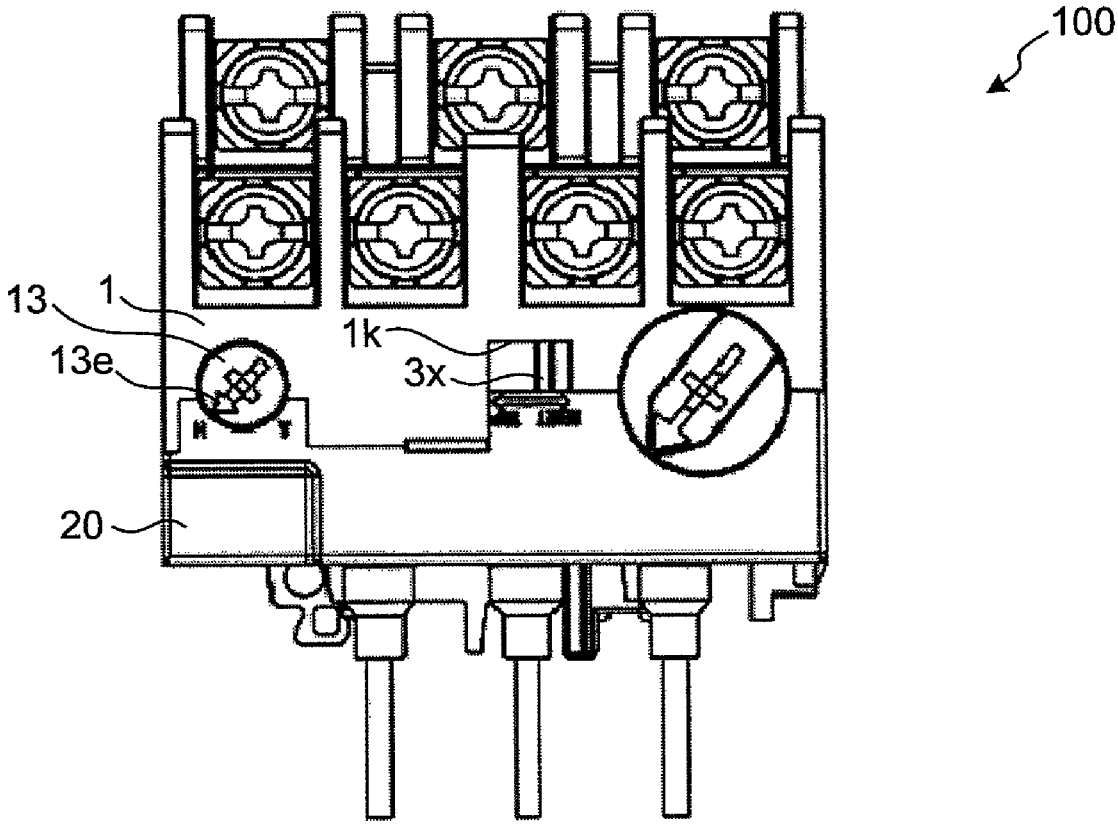
FIG. 14 is a plan view of a reset state of the manual reset mode.

FIG. 14 is a plan view of a reset state of the manual reset mode of the overload relay. As shown in FIG. 14, in the manual reset mode, the reset bar 13 is twisted clockwise, and a columnar head thereof projects outside the case 1. An arrow of an arrow groove 13*e* (see FIG. 10; this also functions as a screw driver groove) formed in the top is directed in an "H" direction that is the same direction as the arrow mark shown on the right side of the upper surface of the case 1, and this shows that the overload relay is set in the manual reset mode.

A left projection stripe 3*x* (see FIG. 4) of a display unit 3*w* that rises in a needle form and that is exposed from a window 1*k* provided in a top of the case 1 is located at a "RESET" position of the window 1*k*, and this indicates that the overload relay 100 is in the reset state. The left projection stripe 3*x* and a right projection stripe 3*y* shown in FIG. 4 have different colors so that they can be distinguished from each other.

Figure 15:
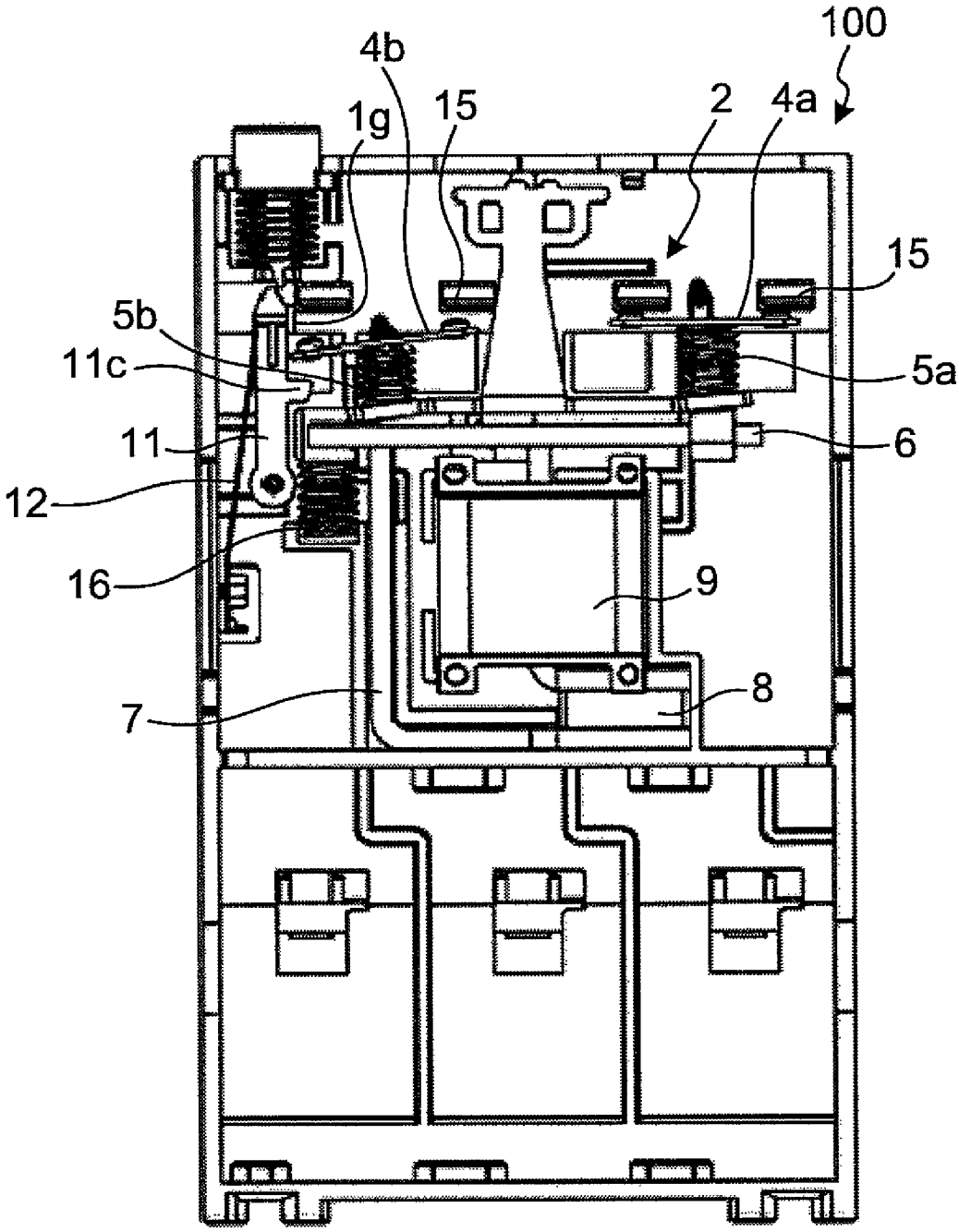
FIG. 15 is a front view of a trip state of the manual reset mode.

FIG. 15 is a front view of a trip state of the manual reset mode of the overload relay. When the overload relay 100 is in the reset state shown in FIG. 13, a current detecting device (not shown) detects overcurrent (overload) of the motor, and if operation current flows through a trip coil 9*b* (see FIG. 7) of the coil 9 from a current detection circuit, a magnetic flux is generated from the trip coil 9*b* in the same direction as that of a magnetic flux generated by the permanent magnet 8, an attracting force of a sum of both the magnetic fluxes is applied to the armature 6, and a counterclockwise torque applied to the armature 6 exceeds a clockwise torque caused by repulsion of the contact mechanism spring 16.

As shown in FIG. 15, the contact mechanism 2 turns counterclockwise against the repulsion of the contact mechanism spring 16, the armature 6 is attracted to the upper end of the first stationary iron core 7, and the overload relay 100 is switched to the trip state (trip position) in the manual reset mode.

In the trip state, the movable contact of the normally-closed movable contact element 4*b* separates from the stationary contact of the stationary contact element 15, the normally-closed circuit is opened, the movable contact of the normally-open movable contact element 4*a* abuts against the stationary contact of the stationary contact element 15, and the normally-open circuit is closed. In this trip state, the contact mechanism 2 transmits an overload signal (normally-closed circuit is opened and the normally-open circuit is closed).

At this time, in the reset state, the abutment of the intermediate engaging unit 11*c* of the movable stopper 11 having been abutted against the left armature holder 3*e* of the cross bar 3 is released, and an upper portion of the movable stopper 11 turns rightward by the repulsion of the stopper leaf spring 12, and the upper portion abuts against a stopper projection 1*g* (see FIG. 3) of the case 1.

A counterclockwise torque of the armature 6 caused by an attracting force of the permanent magnet 8 with respect to the armature 6 that is attached to the upper end of the first stationary iron core 7 exceeds a clockwise torque caused by repulsion of the contact mechanism spring 16 and the normally-open contact spring 5*a*. Therefore, the trip state is maintained.

Figure 16:
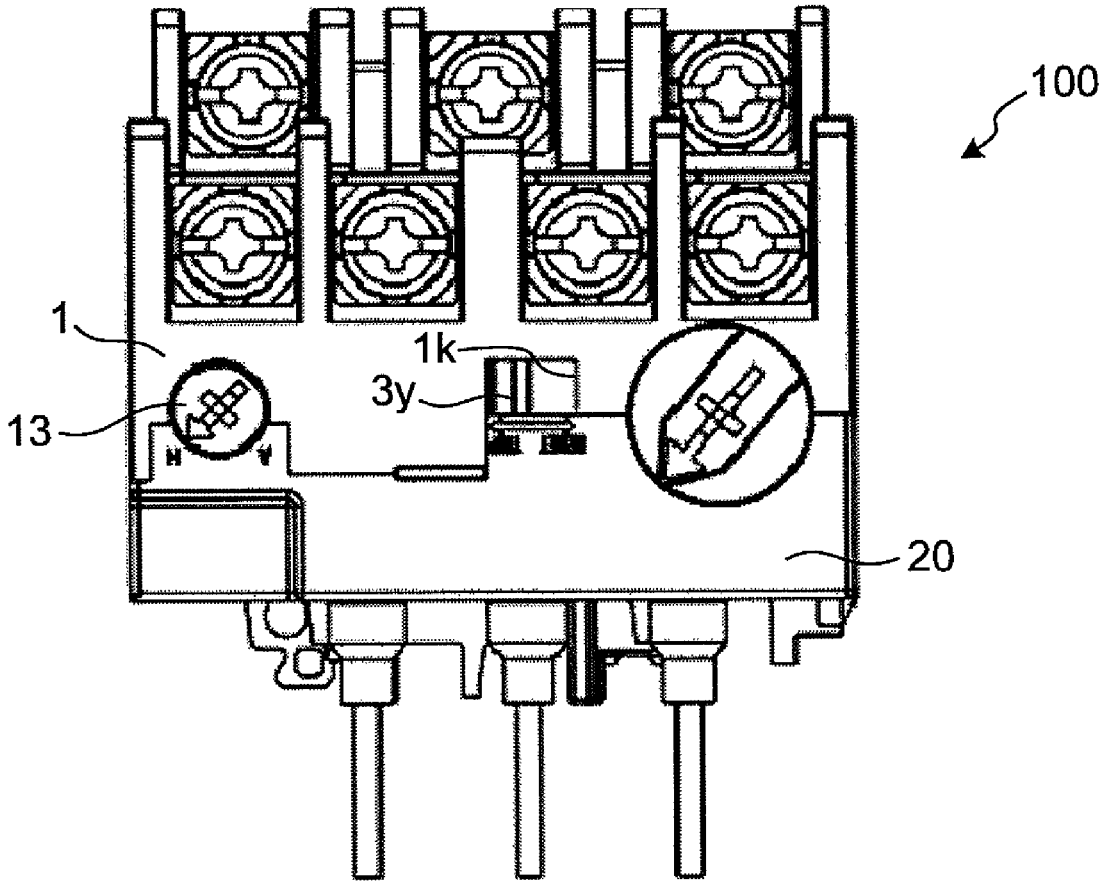
FIG. 16 is a plan view of the trip state of the manual reset mode.

FIG. 16 is a plan view of the trip state of the manual reset mode of the overload relay. As shown in FIG. 16, the right projection stripe 3*y* (see FIG. 4) of the display unit 3*w* of the cross bar 3 is located at the "TRIP" position of the window 1*k* provided in the top of the case 1, and this indicates that the overload relay 100 is in the trip state.

Figure 17:
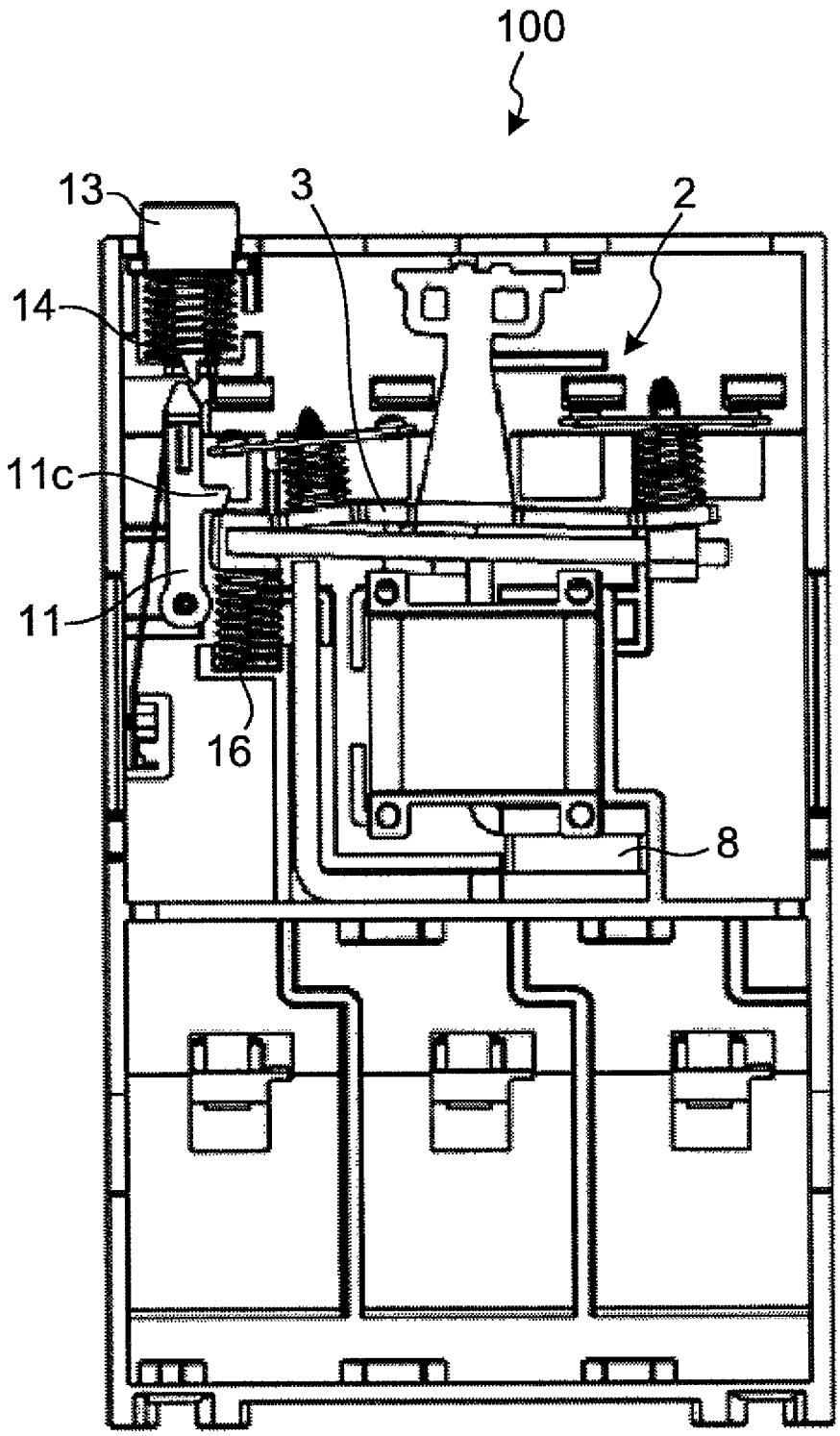
FIG. 17 is a front view of a state where, in the manual reset mode, a contact mechanism turns through a short distance to an engagement position of a movable stopper.

A manual reset operation from the trip state to the reset state of the manual reset mode is explained next. FIG. 17 is a front view of a state where in the manual reset mode, the contact mechanism 2 turns through a short distance to an engagement position with the intermediate engaging unit 11*c* of the movable stopper 11 and the manual resetting can be performed.

When a predetermined time is elapsed after the overload relay 100 is in the trip state shown in FIG. 15, current flows through a reset coil 9*c* (see FIG. 7) of the coil 9 from the current detection circuit (not shown) in a direction opposite to that when an overload is detected. With this current, a magnetic flux is generated by the reset coil 9*c* in a direction opposite to the magnetic flux of the permanent magnet 8, and the magnetic flux of the permanent magnet 8 is canceled. It is preferred that the predetermined time corresponds to a time during which a device such as a motor heated by the overload is cooled.

If the magnetic flux of the permanent magnet 8 is canceled, the armature 6 is opened and separated from the upper end of the first stationary iron core 7 by repulsion of the contact mechanism spring 16, the contact mechanism 2 turns clockwise through a short distance, a left end upper portion of the cross bar 3 is engaged with the intermediate engaging unit 11*c* of the movable stopper 11, and the manually resettable state shown in FIG. 17 is established.

In the state shown in FIG. 17, if the reset bar 13 is pushed in against the reset bar spring 14, an inclined surface 13*b* (see FIG. 11) of a lower end of the reset bar 13 abuts against an inclined surface 11*b* (see FIG. 9) of the upper end of the movable stopper 11, the movable stopper 11 is turned slightly leftward by the wedge effect, engagement between the intermediate engaging unit 11*c* of the movable stopper 11 and the left end upper portion of the cross bar 3 is released, and the contact mechanism 2 is turned to the reset state shown in FIG. 13 by the repulsion of the contact mechanism spring 16. With this configuration, the overload relay 100 can be manually reset.

Figure 18:
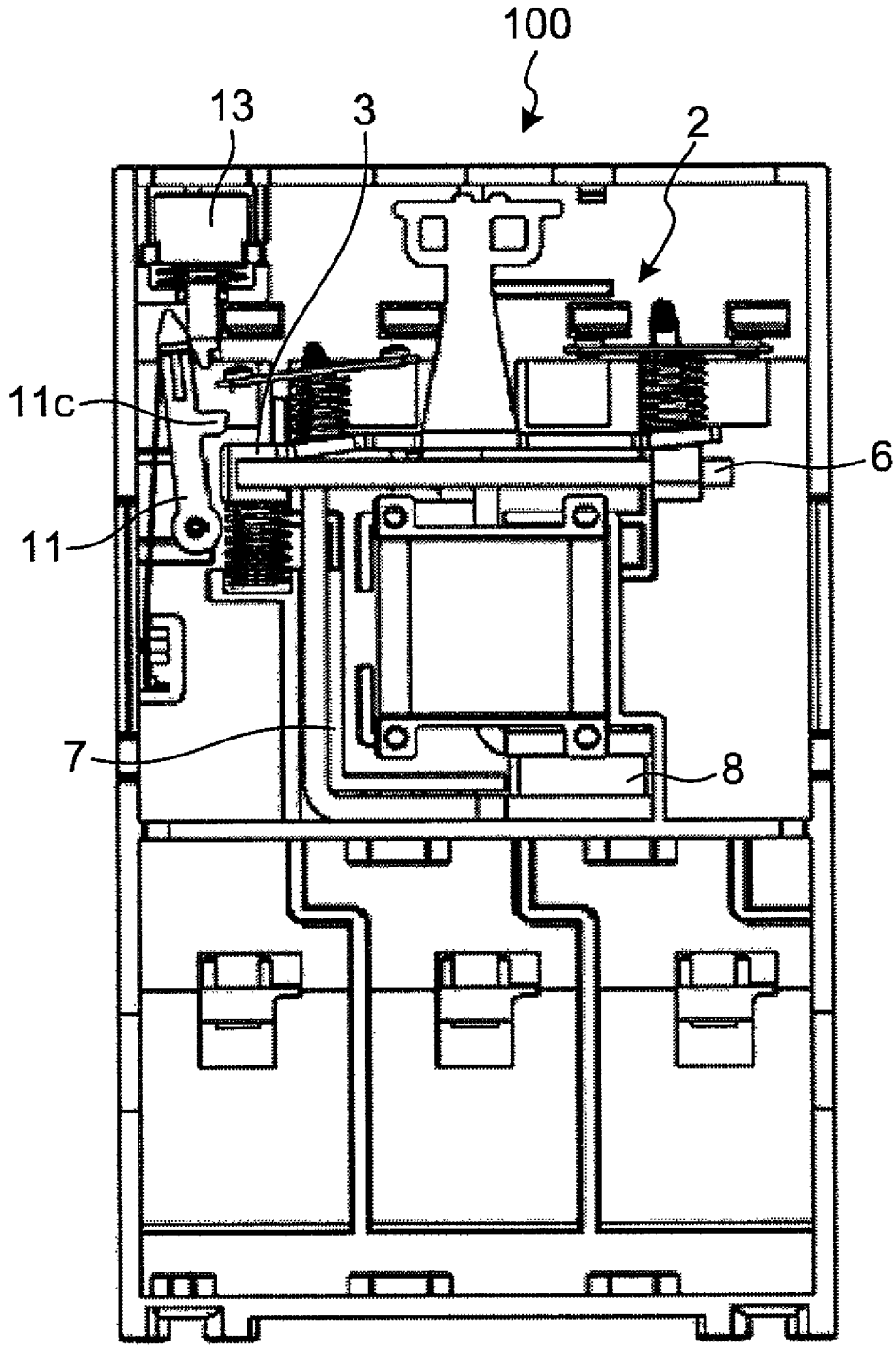
FIG. 18 is a front view of a state where, in the manual reset mode, the contact mechanism is in the trip state, and a reset bar is pushed in before a coil is excited.

FIG. 18 is a front view of a state where in the manual reset mode, a predetermined time is not elapsed after the contact mechanism 2 is in the trip state, the reset coil 9*c* (see FIG. 7) is excited and the reset bar 13 is pushed in before the contact mechanism 2 turns clockwise through a short distance.

When the reset bar 13 is pushed in, the movable stopper 11 slightly turns leftward. However, because the armature 6 is attracted by the first stationary iron core 7 and the contact mechanism 2 is not engaged with the movable stopper 11, the contact mechanism 2 is not reset.

To reset the contact mechanism 2 and to return it to the reset state, it is necessary that the armature 6 and the upper end of the first stationary iron core 7 are slightly separated from each other, the left end upper portion of the cross bar 3 is engaged with the intermediate engaging unit 11*c* of the movable stopper 11, and the reset bar 13 is pushed in. The current detection circuit (not shown) does not supply current to the reset coil 9*c* until a predetermined time is elapsed after the trip. Therefore, resetting cannot be performed for a predetermined time after the trip.

Figure 19:
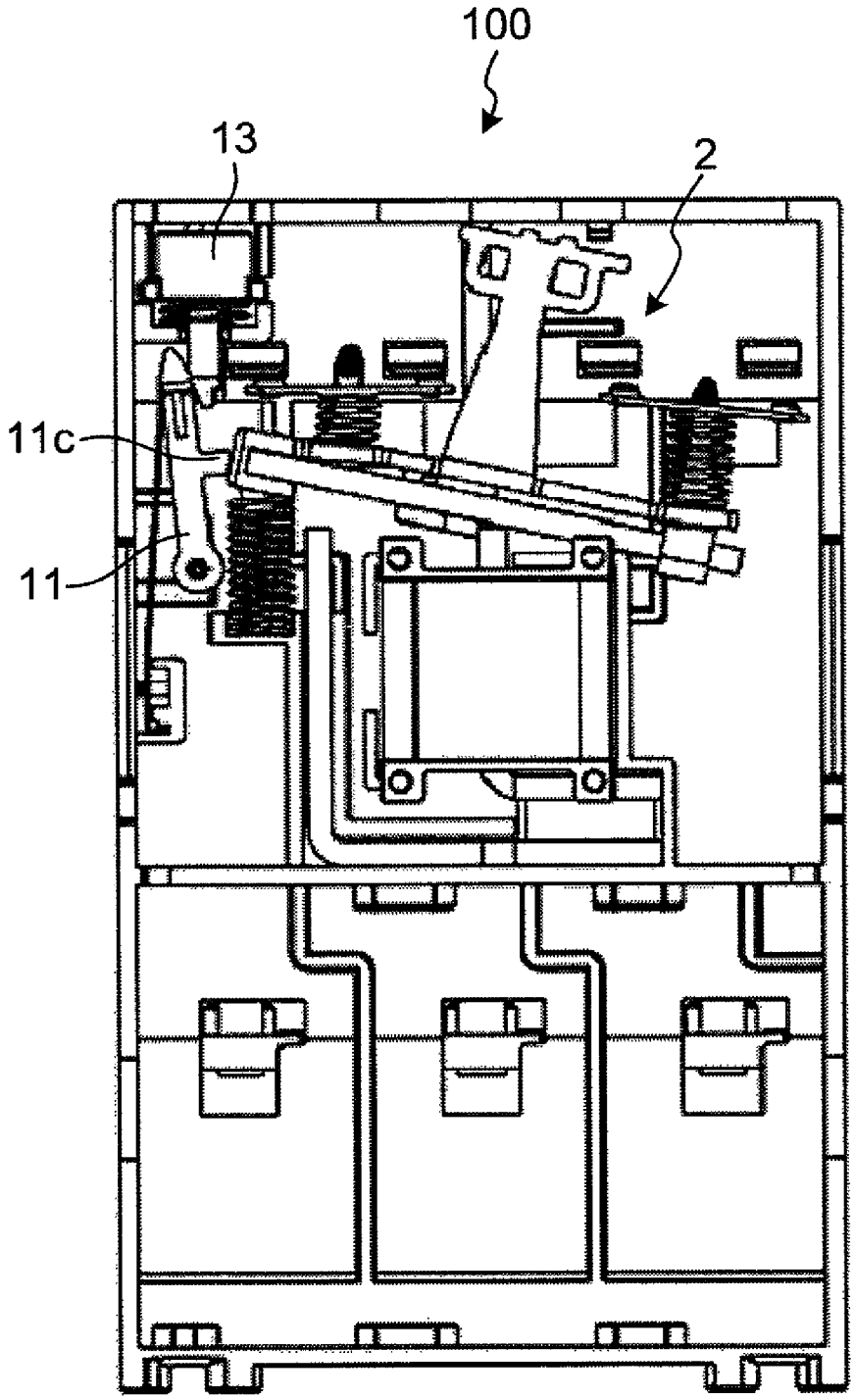

FIG. 19 is a front view of a state where the reset bar is pushed in in the reset state of the manual reset mode. The contact mechanism 2 is not restrained by the reset bar 13 or the movable stopper 11 even in a state where the reset bar 13 is left pushed in. Therefore, if current is supplied to the trip coil 9*b* from the current detection circuit, the contact mechanism 2 can trip without any problem. Therefore, the overload relay 100 according to the embodiment has a trip free function.

Figure 20:
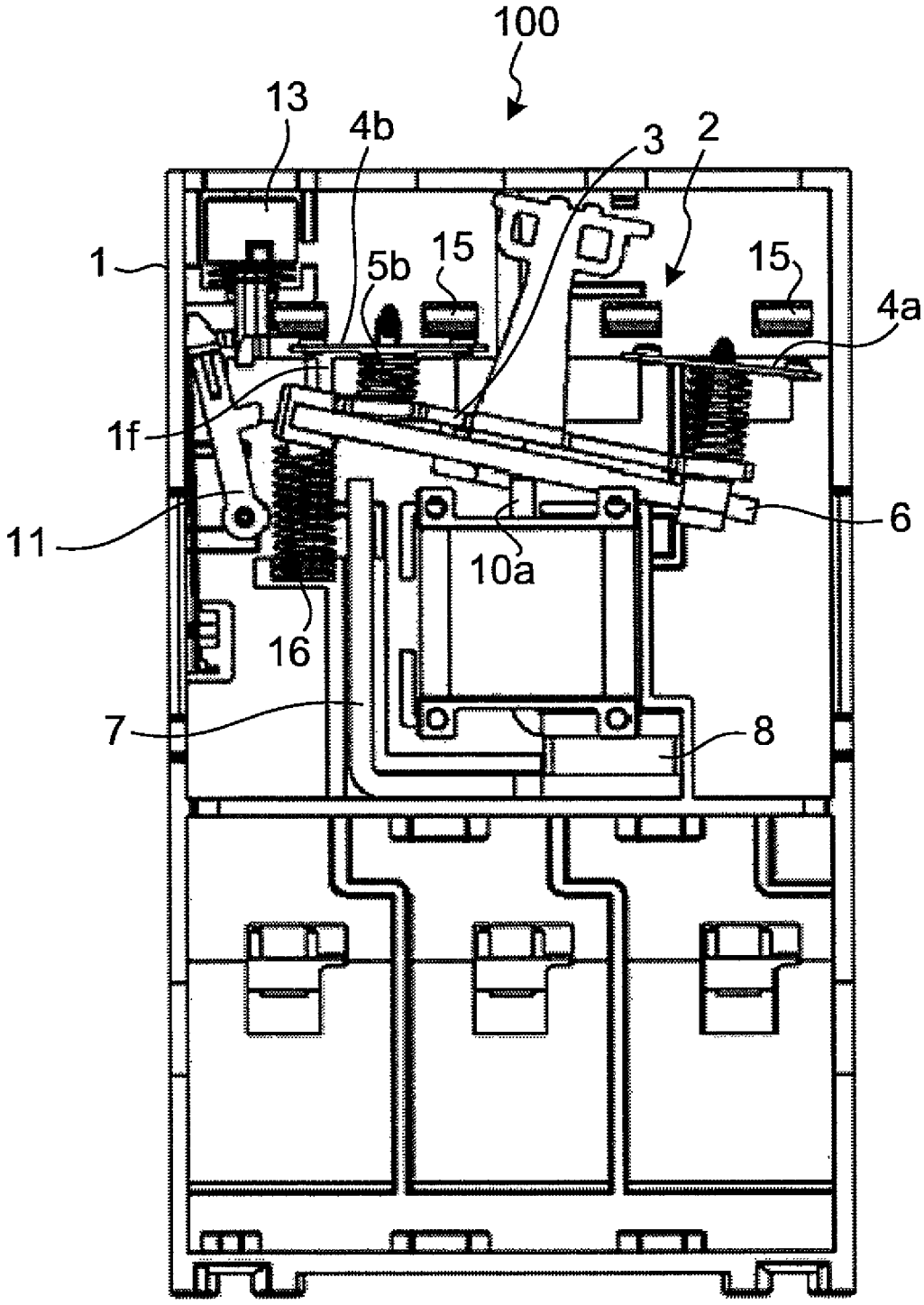
FIG. 20 is a front view of a reset state of an automatic reset mode of the overload relay.

FIG. 20 is a front view of a reset state of the automatic reset mode of the overload relay. When the overload relay 100 is switched from the manual reset mode to the automatic reset mode, the reset bar 13 is pushed into the case 1, and outer peripheral projections 13*d* and 13*d* (see FIGS. 10 and 11) provided on a lower portion of a head of the reset bar 13 are abutted against bar stoppers 1*h* and 1*h* (see FIG. 3) of the case 1.

The reset bar 13 is then rotated 90° counterclockwise, the movable stopper 11 is turned leftward by a lower projection 13*c* (see FIG. 12) of the reset bar 13, a tip end of the lower projection 13*c* is abutted against the movable stopper 11, and the reset bar 13 is switched to a non-engagement position where the movable stopper 11 is not engaged with the cross bar 3.

If the reset bar 13 is rotated 90° counterclockwise, one outer peripheral projection 13*d* of the reset bar 13 is abutted against a rib 1*i* (see FIG. 3) of the case 1. Therefore, the reset bar 13 does not rotate more than 90° counterclockwise. If the reset bar 13 is rotated 90° counterclockwise, the reset bar 13 is engaged with a projection 1*j* provided on the rib 1*i* of the case 1. Thus, the reset bar 13 is not pushed back as it is by the repulsion of the reset bar spring 14.

A clockwise torque of the armature 6 caused by the repulsion of the contact mechanism spring 16 is greater than a counterclockwise torque of the armature 6 caused by the attracting force of the permanent magnet 8 and by the repulsion of the normally-closed contact spring 5*b*. Therefore, the contact mechanism 2 turns clockwise around the pivot on the upper end of the armature shaft 10*a*, and is held in such an attitude that the contact mechanism 2 abuts against the reset position stopper if (see FIG. 2) of the case 1.

In the reset state, the movable contact of the normally-closed movable contact element 4*b* abuts against the stationary contact of the stationary contact element 15 to close the normally-closed circuit, the movable contact of the normally-open movable contact element 4*a* separates from the stationary contact of the stationary contact element 15 to open the normally-open circuit. In this reset state, the contact mechanism 2 transmits a standby signal (the normally-closed circuit is closed and the normally-open circuit is opened).

Figure 21:
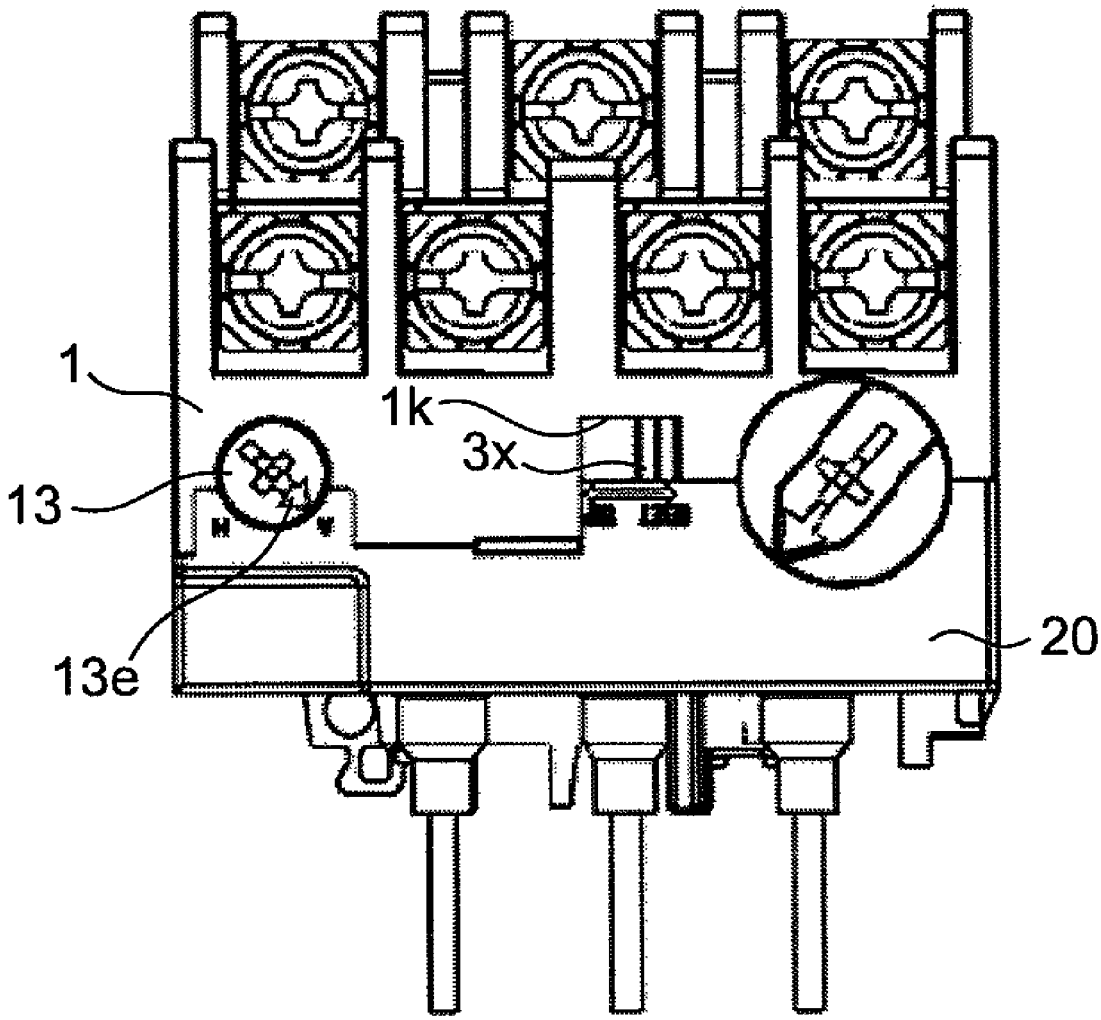
FIG. 21 is a plan view of the reset state of the automatic reset mode.

FIG. 21 is a plan view of the reset state of the automatic reset mode of the overload relay. As shown in FIG. 21, in the automatic reset mode, the reset bar 13 is pushed into the case 1, twisted counterclockwise, the arrow of the arrow groove 13*e* formed in the top is directed toward the "A" direction, and the overload relay is set to the automatic reset mode.

The left projection stripe 3*x* of the display unit 3*w* of the cross bar 3 is located at the "RESET" position of the window 1*k* provided in the top of the case 1 and the state is the reset state.

Figure 22:
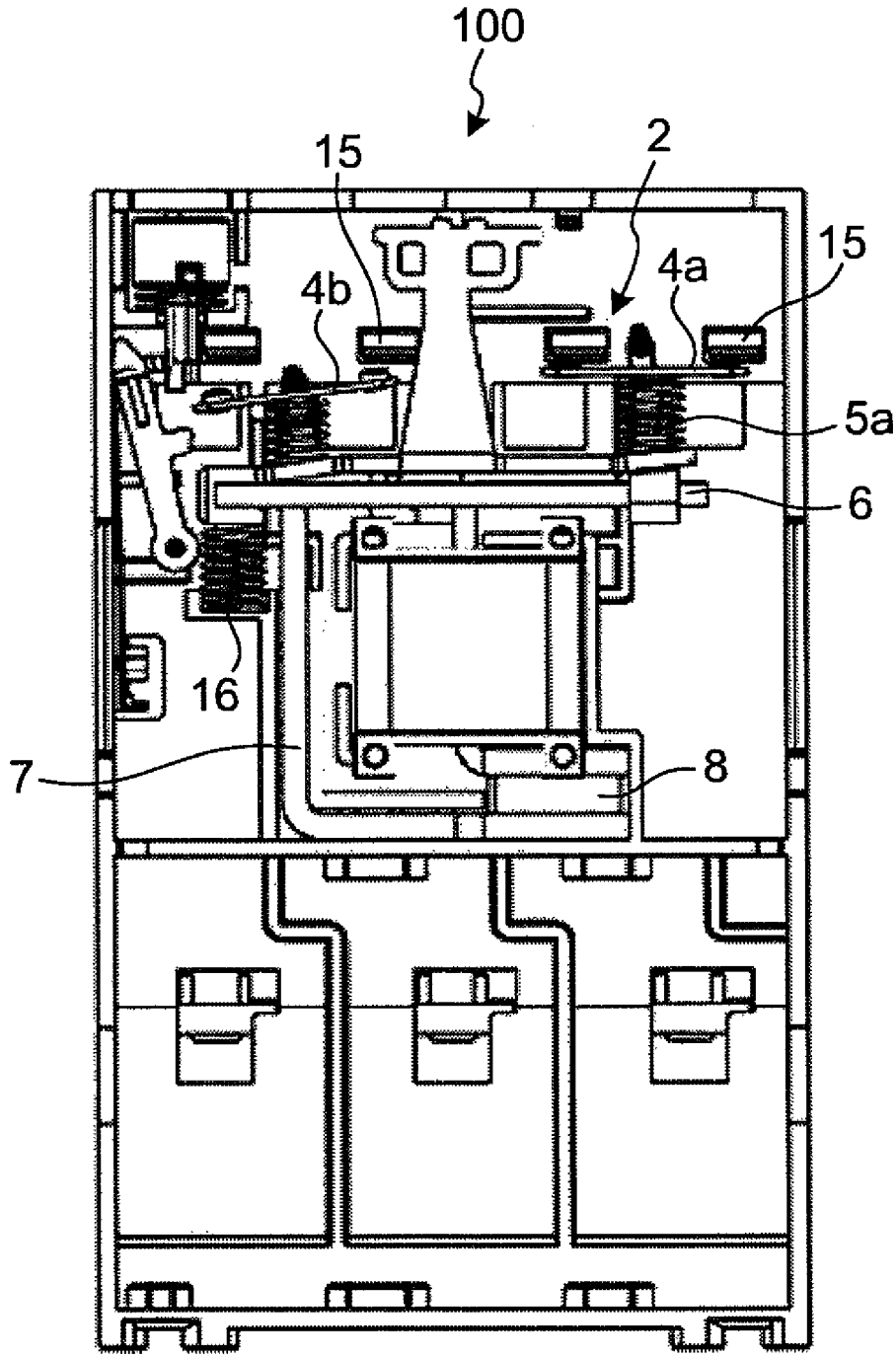
FIG. 22 is a front view of a trip state of the automatic reset mode.

FIG. 22 is a front view of the trip state of the automatic reset mode of the overload relay. When the overload relay 100 is in the reset state of the automatic reset mode shown in FIG. 20, the current detecting device (not shown) detects overcurrent (overload) of a device such as a motor. If operation current flows through the trip coil 9*b* (see FIG. 7) of the coil 9 from the current detection circuit, a magnetic flux is generated from the trip coil 9*b* in the same direction as a magnetic flux caused by the permanent magnet 8, attracting forces of the sum of both the magnetic fluxes are applied to the armature 6, and a counterclockwise torque applied to the armature 6 exceeds a clockwise torque caused by the repulsion of the contact mechanism spring 16.

As shown in FIG. 22, the contact mechanism 2 turns counterclockwise, the armature 6 is attracted by the upper end of the first stationary iron core 7, and the overload relay 100 is shifted to the trip state of the automatic reset mode.

In the trip state, the movable contact of the normally-closed movable contact element 4*b* separates from the stationary contact of the stationary contact element 15 to open the normally-closed circuit, and the movable contact of the normally-open movable contact element 4*a* abuts against the stationary contact of the stationary contact element 15 to close the normally-open circuit. In this trip state, the contact mechanism 2 transmits an overload signal (the normally-closed circuit is opened and the normally-open circuit is closed).

If the armature 6 is attracted by the upper end of the first stationary iron core 7, a counterclockwise torque of the armature 6 caused by the attracting force of the permanent magnet 8 exceeds a clockwise torque caused by the repulsion of the contact mechanism spring 16 and the normally-open contact spring 5*a* and thus, the trip state is maintained.

If a predetermined time is elapsed after the overload relay 100 is in the trip state of the automatic reset mode shown in FIG. 22, current flows through the reset coil 9*c* (see FIG. 7) of the coil 9 from the current detection circuit (not shown) in the direction opposite to that when an overload is detected.

A magnetic flux is generated by the reset coil 9*c* in the direction opposite to the magnetic flux of the permanent magnet 8 to cancel the magnetic flux of the permanent magnet 8, the contact mechanism 2 turns clockwise by the repulsion of the contact mechanism spring 16, and the overload relay is shifted to the reset state shown in FIG. 20.

The inclined attitude of the contact mechanism 2 in the reset state of the manual reset mode shown in FIG. 13 and the inclined attitude of the contact mechanism 2 in the reset state of the automatic reset mode shown in FIG. 20 are the same. The inclined attitude of the contact mechanism 2 when the manual resetting shown in FIG. 17 can be performed is substantially the same as the inclined attitude of the contact mechanism 2 in the trip state of the automatic reset mode shown in FIG. 22 because only difference of the former attitude is that the contact mechanism 2 slightly turns from the latter attitude.

Therefore, because the contact gap and the over-travel amount of the normally-open contact in the automatic reset mode, and the contact gap and the over-travel amount in the manual reset mode are substantially the same, the resistance to pressure and the contact capacity are not reduced.

According to the overload relay 100, the display unit 3*w* of the cross bar 3 is exposed from the window 1*k* provided in the top of the case 1 as shown in FIGS. 1, 14, 16, and 21, the contact mechanism 2 can be turned clockwise and counterclockwise by manually moving (operating) the display unit 3*w* in the lateral direction, and the test trip and resetting can be performed even if there is no power source.

Further, as shown in FIG. 5, a mounting portion of the left spring column 3*b* of the cross bar 3 is inclined downward with respect to the central portion, and the spring column 3*b* is inclined leftward. With this inclination, the contact mechanism 2 is turned clockwise and is shifted to the reset state. When the normally-closed movable contact element 4*b* comes into contact with the two stationary contact elements 15 and 15, or when the normally-closed movable contact element 4*b* separates from the two stationary contact elements 15 and 15 on the contrary, the spring column 3*b* is oriented substantially perpendicularly to a line connecting the two stationary contact elements 15 and 15 with each other so that an unbalanced load of the normally-closed contact spring 5*b* is not applied to the normally-closed movable contact element 4*b*.

Further, with the shape described above, movable contacts on both ends of the normally-closed movable contact element 4*b* simultaneously come into contact with the stationary contacts of the stationary contact elements 15 and 15, and open and separate. Therefore, arc does not concentrate on a contact on one side when current is blocked, wear of the contact becomes small and deterioration of the current interruption performance becomes less. It is preferred that the spring column 3*a* is designed in the same manner as the spring column 3*b*.

Industrial Applicability

As described above, the electronic overload relay according to the present invention is useful as an overload relay with a high resistance to pressure.

The invention claimed is:

1. An electronic overload relay that is packaged in a case, the electronic overload relay comprising:

a contact mechanism that is switched between a trip position at which an overload signal is transmitted and a reset position at which a standby signal is transmitted;

a magnetic circuit that includes a stationary iron core, a permanent magnet, and an armature that is fixed to the contact mechanism and that is switched between a trip position at which the armature is attracted by the stationary iron core and a reset position at which the armature is separated from the stationary iron core, arranged in a circular pattern;

a contact mechanism spring that separates the armature from the stationary iron core and opens the magnetic circuit to bias such that the contact mechanism is switched to the reset position;

a coil that is arranged on the magnetic circuit, generates a magnetic flux in a same direction as a magnetic flux of the permanent magnet by energization when an overload is detected, thereby switching the armature from the reset position to the trip position against the contact mechanism spring, and generates a magnetic flux in a direction opposite to the magnetic flux of the permanent magnet by energization in the opposite direction when a predetermined time is elapsed after detecting an overload, thereby opening and separating the armature held at the trip position from the stationary iron core by an attracting force of the permanent magnet;

a movable stopper that engages with the contact mechanism against a biasing force of the contact mechanism spring at a position where the armature is slightly separated from the stationary iron core; and a reset bar that switches the movable stopper between an engaging position where the contact mechanism is engaged and a non-engaging position.

2. The electronic overload relay according to claim 1, wherein, in a manual reset mode where the contact mechanism in the trip state is manually reset, the reset bar switches the movable stopper to the engaging position, and in an automatic reset mode where the contact mechanism is automatically reset when a predetermined time is elapsed after detecting an overload, the reset bar switches the movable stopper to the non-engaging position.

3. The electronic overload relay according to claim 2, wherein, in the manual reset mode, the reset bar is pushed into the case, the reset bar releases engagement of the movable stopper that engages with the contact mechanism against a biasing force of the contact mechanism spring at a position where the armature is slightly opened and separated from the stationary iron core, and in the automatic reset mode, the reset bar is pushed into the case and rotated, and the movable stopper is switched to the non-engaging position.

4. The electronic overload relay according to claim 1, wherein the predetermined time corresponds to a time during which a device heated by an overload is cooled.

5. The electronic overload relay according to claim 1, wherein the contact mechanism includes a cross bar that resiliently holds a movable contact element by a contact spring, the cross bar includes a display unit that is exposed to a window provided in the case, and whether the contact mechanism is in the reset position or in the trip position is indicated by a position of the display unit with respect to the window.

6. The electronic overload relay according to claim 5, wherein a test trip and resetting are performed with no energization by operating the display unit.

7. The electronic overload relay according to claim 5, wherein the cross bar includes a spring column that holds the contact spring and the movable contact element, and the spring column is provided on the cross bar such that the spring column is substantially perpendicular to a line connecting two stationary contact elements with each other when the movable contact comes into contact with the two stationary contact elements.

* * * * *